US006928919B2

(12) United States Patent
Parsch

(10) Patent No.: US 6,928,919 B2
(45) Date of Patent: Aug. 16, 2005

(54) WOBBLE PLATE PISTON MECHANISM

(75) Inventor: Willi Parsch, Seeheim (DE)

(73) Assignee: LuK Fahrzeug-Hydraulik GmbH & Co., KG, Bad Homburg (DE)

( * ) Notice: Subject to any disclaimer, the term of this patent is extended or adjusted under 35 U.S.C. 154(b) by 0 days.

(21) Appl. No.: 10/441,361

(22) Filed: May 12, 2003

(65) Prior Publication Data

US 2004/0007126 A1 Jan. 15, 2004

Related U.S. Application Data

(63) Continuation of application No. PCT/DE01/03771, filed on Sep. 26, 2001.

(30) Foreign Application Priority Data

Nov. 10, 2000 (DE) ..... 100 55 727

(51) Int. Cl.[7] ..... F01B 3/02
(52) U.S. Cl. ..... 92/12.2; 74/839
(58) Field of Search ..... 91/505; 92/12.2; 74/839; 417/222.1, 222

(56) References Cited

U.S. PATENT DOCUMENTS 4,236,875 A * 12/1980 Widdowson ..... 714/222.2
5,540,559 A 7/1996 Kimura et al.
6,164,252 A * 12/2000 Kuhn et al. ..... 123/56.3
6,210,124 B1 * 4/2001 Fagerli et al. ..... 417/222.1
6,474,183 B1 * 11/2002 Uchikado ..... 417/222.1

FOREIGN PATENT DOCUMENTS

DE 195 27 649 A1 1/1997
DE 197 49 727 A 1 11/1997
JP 05172046 A 7/1993

* cited by examiner

*Primary Examiner*—F. Daniel Lopez
(74) *Attorney, Agent, or Firm*—Darby & Darby

(57) ABSTRACT

In a wobble plate piston-drive mechanism, the inclination of the ring-shaped wobble plate is adjustable through an articulated connection of the wobble plate to the shaft by means of an axially movable guiding device and a driver arm that reaches into an engagement cavity of the wobble plate at a radial distance from the shaft to transmit the driving force from the shaft to the wobble plate. The driver arm head and/or the engagement cavity are shaped so that the force-transmitting contact between the driver arm head and the annular wobble plate is moved away from the area where the engagement cavity has its minimum wall thickness. This prevents or reduces deformation of the gliding surface of the wobble plate and thus makes the mechanism run more smoothly.

10 Claims, 4 Drawing Sheets

WOBBLE PLATE PISTON MECHANISM

CROSS-REFERENCE TO RELATED APPLICATION

This application is a continuation of International Patent Application Ser. No. PCT/DE 01/03771, filed Sep. 26, 2001, which is hereby incorporated by reference in its entirety.

BACKGROUND OF THE INVENTION

The present invention relates to a piston-drive mechanism in which a revolving wobble plate is driven by a driving shaft. The angle of inclination of the wobble plate relative to the driving shaft is adjustable. The adjustable inclination is achieved through an articulated connection of the wobble plate to the shaft by means of an axially movable guiding device as well as a driver arm that engages the wobble plate at a radial distance from the shaft to transmit the driving force from the shaft to the wobble plate. The pistons move parallel to the driving shaft. Each of the pistons has a glider element that is coupled to the piston with ball joint-like mobility. As the revolving wobble plate is in gliding engagement with the glider element, the rotation of the wobble plate results in a reciprocating axial movement of the piston. The wobble plate, which has the shape of an annular disk, has a cavity at one location of the circumference, with an opening of the cavity facing towards the center of the disk. The aforementioned driver arm, which is rigidly connected to the driving shaft, has at its free end a head that extends into the cavity, so that the driving force is transmitted to the ring-shaped wobble plate through the engagement of the driver arm head with the cavity wall inside the wobble plate.

A wobble plate piston mechanism of this kind is disclosed in DE 197 49 7272 A1, where the driver arm has a ball-shaped driver arm head extending into a cylindrical cavity of the wobble plate, also referred to as engagement cavity. The driver arm of this mechanism may also be referred to as torque transmitter, and the wobble plate is alternately referred to as annular swivel disk or swivel ring. The contact between the driver arm and the annular wobble plate takes place along the contact circle between the spherical driver arm head and the cylindrical engagement cavity, whereby the contact area is maximized. In this mechanism, the arrangement of a spherical driver arm head and a cylindrical engagement cavity has the disadvantage, that the gliding surfaces of the annular wobble plate are deformed into an uneven shape, which interferes with a smooth gliding of the glider elements (also referred to as glider shoes) on the annular wobble plate. In the vicinity of the cylindrical bore cavity of the wobble plate, where the spherical driver arm head applies an axial force parallel to the driving shaft, there is only a thin wall of material left between the cavity and the gliding surface so that this surface portion is subject to a strong deformation. Because of the uneven gliding surface, the glide shoes will not glide smoothly on the annular wobble plate.

OBJECTIVE AND SUMMARY OF THE INVENTION

The present invention therefore has the objective to improve a wobble plate piston mechanism of the kind described above, so that the problem of the deformation of the glide surfaces of the annular wobble plate is alleviated or even removed.

The invention offers a solution by proposing a piston-drive mechanism with a revolving wobble plate that is driven by a driving shaft and whose angle of inclination relative to the driving shaft is adjustable. The adjustable inclination is achieved through an articulated connection of the wobble plate to the shaft by means of an axially movable guiding device as well as a driver arm that engages the wobble plate at a radial distance from the shaft to transmit the driving force from the shaft to the wobble plate. Each of the pistons has a glider element supported in the piston with ball joint-like mobility. As the revolving wobble plate is in gliding engagement with the glider element, the rotation of the wobble plate results in a reciprocating axial movement of the piston. The wobble plate has the shape of an annular disk. At one location of the circumference, the annular disk has a cavity that is open at least in the radial direction towards the center of the disk. The aforementioned driver arm, which is rigidly connected to the driving shaft, has at its free end a head that extends into the cavity, so that the driver arm transmits its driving force to the annular wobble plate through the engagement of the driver arm head in the engagement cavity of the annular wobble plate. According to the invention, the driver arm head and/or the engagement cavity are shaped so that the axial force-transmitting contact between the driver arm head and the annular wobble plate is moved away from the area where the engagement cavity has its minimum wall thickness. Thus, the places where the driver arm head exerts an axial force against the cavity wall are shifted laterally to areas of greater wall thickness and thus farther back in the axial direction away from the piston.

In a wobble plate piston mechanism according to the invention, the otherwise spherical head of the driver arm is flattened in the portion that faces towards the pistons, so that the driver arm head presents an oval contour, seen in a viewing direction transverse to the driving shaft and in line with the driver arm. The flattened driver arm head is used in combination with a cylindrical engagement cavity, i.e., a bore cavity of circular cross-section.

With the flattened, oval-shaped head, the contact points where the oval-shaped driver arm head bears against the circular cross-section of the engagement cavity lie to the right and left of the cavity. Thus, the places where the driver arm head bears against the cavity wall are shifted laterally to areas of greater wall thickness and thus farther back in the axial direction away from the piston.

In another wobble plate piston mechanism according to the invention, the engagement cavity has a cross-section that is ovally or elliptically elongated in the direction of the longitudinal axis of the mechanism, while the driver arm head is spherical. Seen in the plane of the contact points between the driver arm head and the engagement cavity, the places where the spherical driver arm head bears against the oval or elliptical cross-section of the engagement cavity again lie to the right and left of the cavity, i.e., the places where the driver arm head bears against the cavity wall are shifted laterally to areas of greater wall thickness and thus farther back in the axial direction away from the piston.

As a preferred concept for a wobble plate piston mechanism, the driver arm and the annular wobble plate are configured so that the compressive contact forces between the driver arm and the annular wobble plate occur in areas other than the area of minimum wall thickness. As the contact points in the inventive wobble plate mechanism are moved to areas where the wall between the engagement cavity and the gliding surface is thicker, the amount of deformation that occurs on the gliding surface nearest the contact points is reduced.

As a consequence, the stress is removed from the thin wall portions in the engagement cavity of the annular wobble plate of a piston-drive mechanism according to the invention.

Under a further preferred concept of the inventive idea, the annular wobble plate is configured so that the wall separating the engagement cavity from the gliding surfaces is thicker on the side of the wobble plate facing towards the piston than on the side facing away from the piston.

BRIEF DESCRIPTION OF THE DRAWINGS

The invention will be discussed in further detail based on several preferred embodiments that are illustrated in the drawings, wherein.

DETAILED DESCRIPTION OF PREFERRED EMBODIMENTS

Figure 1B:
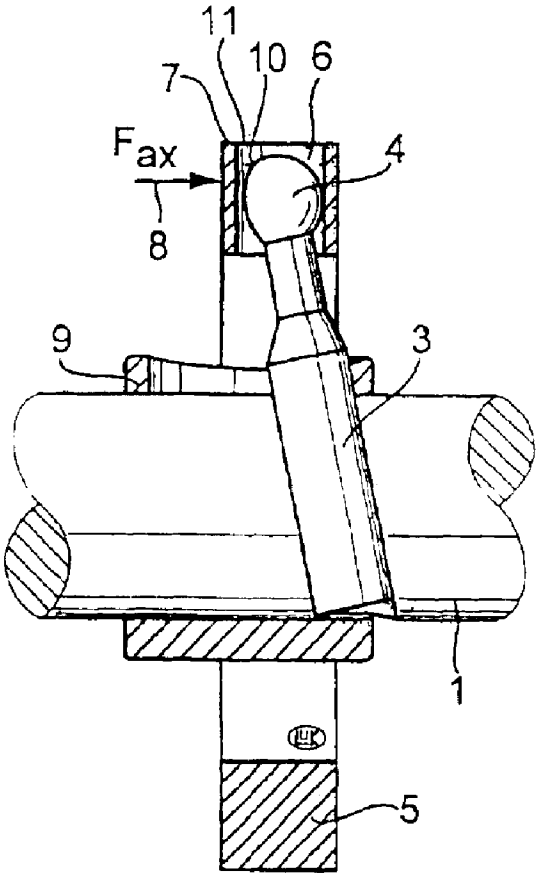
FIG. 1*b* represents a driver arm and an annular wobble plate of a wobble plate mechanism according to the invention.
Figure 1A:
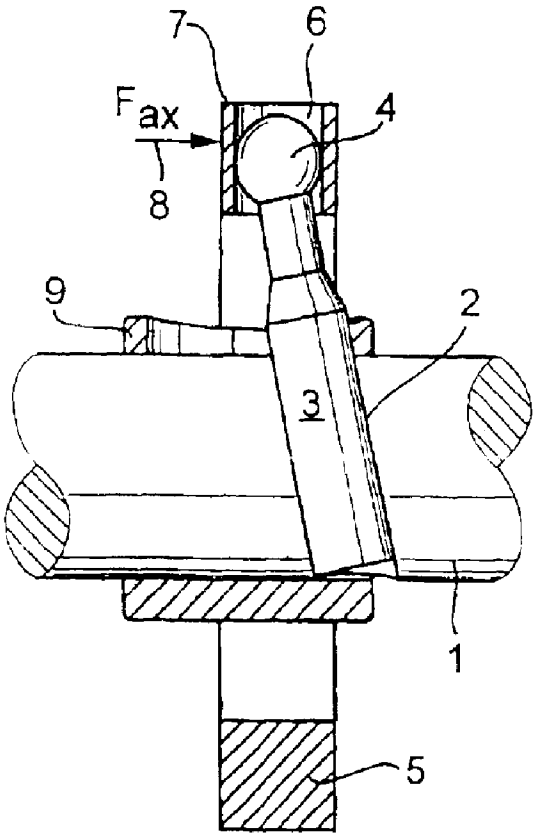
FIG. 1*a* represents a driver arm and an annular wobble plate of a wobble plate mechanism according to the state of the prior art.

FIG. 1*a* gives a cross-sectional view of a driving shaft 1 of a wobble plate piston mechanism where a driver arm 3 (also referred to as torque transmitter) is anchored in an opening. At the free end that protrudes from the driving shaft 1, the driver arm has a neck of smaller diameter terminating in a spherical head 4. The annular wobble plate 5, shown here in cross-section, has a cylindrical cavity 6 receiving the spherical head 4. The arrangement of the cylindrical cavity 6 creates the problem that the glide surface of the wobble plate is backed by a relatively thin wall portion 7 precisely in the area that receives the axial forces 8 which act between the wobble plate and the pistons. Also shown in FIG. 1 is an axial sleeve guide 9 on the driving shaft 1, which is disclosed in DE 197 49 727 and will not be discussed herein in further detail. In the embodiment of the driver arm and wobble plate according to FIG. 1*b*, the spherical head 10 is flattened on the side facing towards the piston, so that the contact points of the driver head are separated from the gliding surface by an additional thickness amount 11 in addition to the minimum wall thickness 7. Thus, the wall thickness at the contact points is increased, so that the extent of the deformation caused by the axial contact forces is lessened.

Figure 2A:
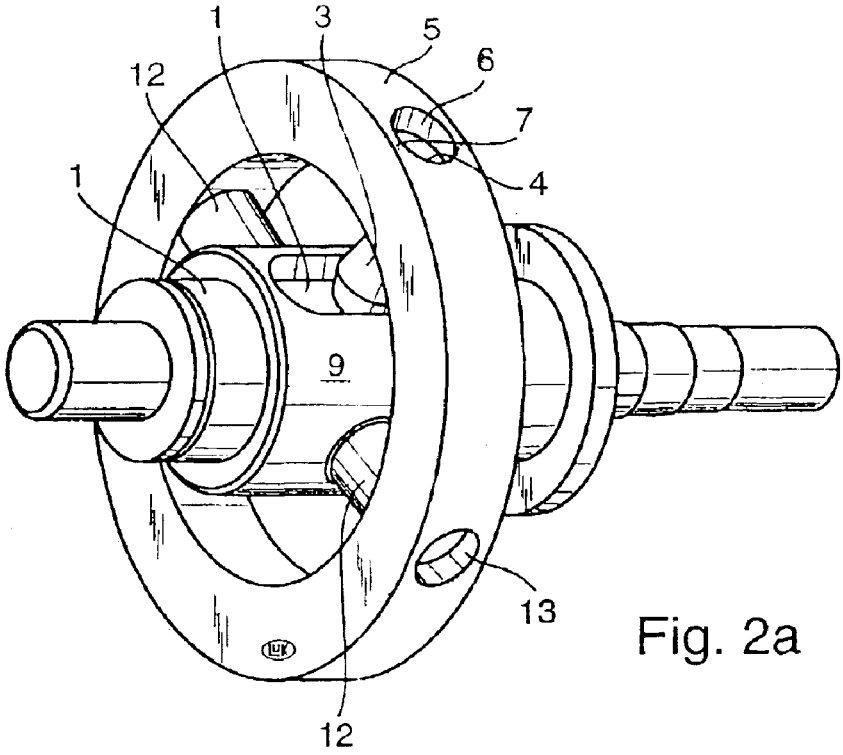
FIG. 2*a* represents a three-dimensional view of a driving shaft with driver arm and annular wobble plate according to the state of the prior art.

FIG. 2*a* illustrates the annular wobble plate 5 and the driver arm 3 of the wobble plate mechanism according to the known state of the art. The annular wobble plate 5 is seen in a perspective view where the driver arm head 4 is just barely visible in the engagement cavity 6. The contact between the driver arm head 4 and the wobble plate 5 occurs at the thin wall portion 7 between the wall cavity and the plane surface of the annular wobble plate. The other end of the driver arm is seated in the driving shaft 1. The axial position of the wobble plate relative to the driving shaft is set by the axial sleeve guide 9 which has two radial arms 12 holding axle pins 13 on which the annular wobble plate is tiltably supported. As the shaft 1 rotates, the torque driving the shaft is passed on to the wobble plate 5 by way of the driver arm 3 bearing against the wall of the engagement cavity 6.

Figure 2B:
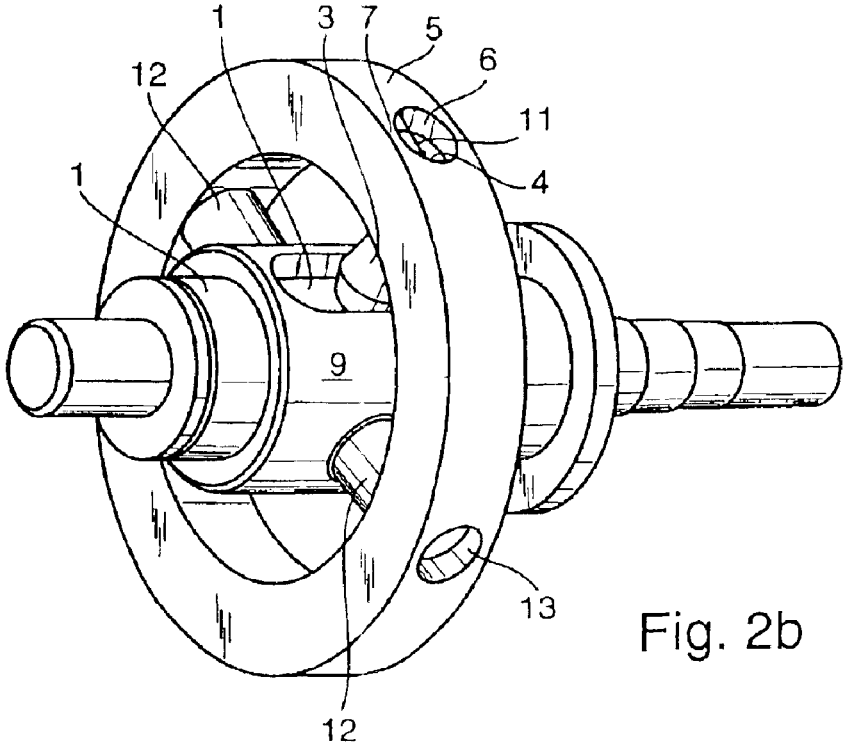
FIG. 2*b* represents a three-dimensional view of a driving shaft with driver arm and annular wobble plate according to the invention.

FIG. 2*b* illustrates a version of the wobble plate and driver arm that embodies the inventive concept. The wall of the engagement cavity 6 at the contact points with the driver arm head 4 has an additional thickness 11 added to the thickness 7 at the thinnest point of the wall, because the driver arm head which is spherical in the case of FIG. 2*a* is now flattened on the side facing towards the piston.

Figure 3A:
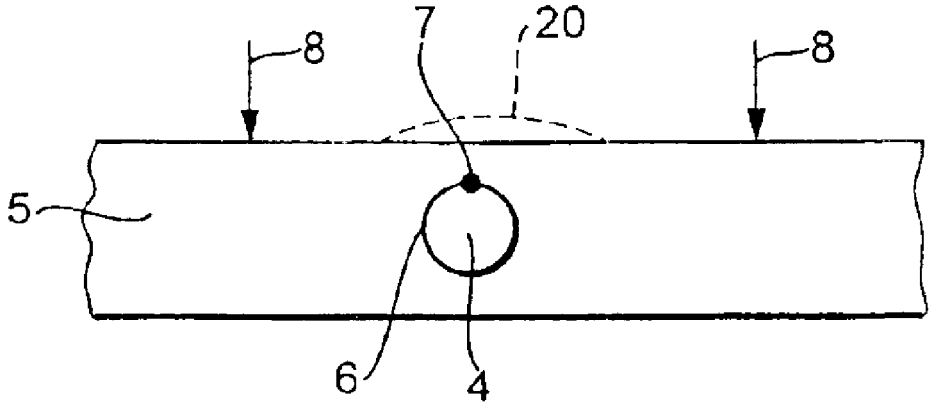
FIG. 3*a* represents a view of the driver arm contacting the wall of the engagement cavity in a wobble plate mechanism according to the state of the prior art.

FIG. 3*a* illustrates the annular wobble plate 5 and the driver arm 3 of the wobble plate mechanism according to the known state of the art. The viewing direction is in line with the driver arm. The contact force of the driver arm head in combination with the forces 8 of the glider shoes of the pistons causes a deformation in the area of the thinnest wall portion between the engagement cavity and the gliding surface of the annular wobble plate 5 as indicated by the broken line 20 in FIG. 3*a*. As a consequence, the glider shoes of the pistons gliding on the wobble plate will encounter a bump at this place and as a result, the mechanism is not operating smoothly.

Figure 3B:
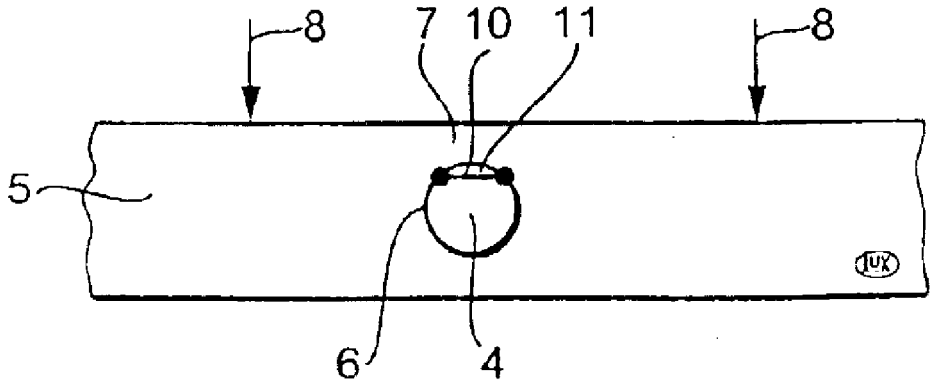
FIG. 3*b* represents a view of the driver arm contacting the wall of the engagement cavity in a wobble plate mechanism according to the invention.

The improved version according to the invention is shown in FIG. 3*b*. The driver arm head 4 is flattened in the area 10 and as a result, the contact points between the driver arm head 4 and the wall of the engagement cavity 6 are moved laterally to areas where the wall is thicker, effectively adding an additional amount of wall thickness 11. Thus, the deforming effect of the axial forces is likewise shifted to the areas of greater wall thickness. As a result, the deformation is reduced to an insignificant amount, so that the glider shoes of the pistons (not shown) will run smoothly on the annular wobble plate of FIG. 3*b*.

To summarize the solution presented in the foregoing embodiment, the problem of the insufficient wall thickness between the engagement cavity and the gliding surface of the annular wobble plate is solved by flattening the originally spherical shape of the driver arm head in the area where the axial contact forces are introduced into the annular wobble plate. The stress field in the contact area is thereby modified in such a way that the critical thin-walled area of the wobble plate is relieved of stress and as a result, the amount of deformation is reduced.

The measure of moving the contact points laterally to areas of greater wall thickness can significantly improve the smoothness of the gliding contact between the gliding shoes and the gliding surface of the wobble plates. If it is not necessary to increase the wall thickness because the existing levels of force are not excessive, the concept of the present invention can be used to save space in the axial direction of the mechanism by reducing the wall thickness 7 at the thinnest point of the wall. As another possibility, one could use the inventive concept to achieve a lower or better distributed contact pressure (force per square inch of contact area) between the driver arm head and the wobble plate. Thus, the invention offers the advantages that a smoother gliding of the glide shoes on the wobble plate can be achieved, that the deformation of the gliding surface on the wobble plate can be reduced by moving the contact points to areas of greater wall thickness or that alternatively, the thickness of the thinnest wall portion can be reduced to save material and space in the mechanism. The space savings in the axial direction can, in turn, be used to increase the tilt angle range of the wobble plate. Furthermore, the inventive concept can eliminate the need for secondary measures to improve the gliding properties of the wobble plate, e.g., a high-hardness-coating such as Balinit®.

In another embodiment of the inventive concept, the engagement cavity 6 is eccentric relative to the equatorial plane of the annular wobble plate in the sense that the bore axis of the engagement cavity 6 is moved away from the gliding surface that receives the axial forces 8. The eccentric arrangement of the engagement cavity 6 may be used as an alternative or additional measure to achieve an added wall thickness 11 in the critical area between the engagement cavity and the gliding surface that receives the axial forces 8.

Figure 4A:
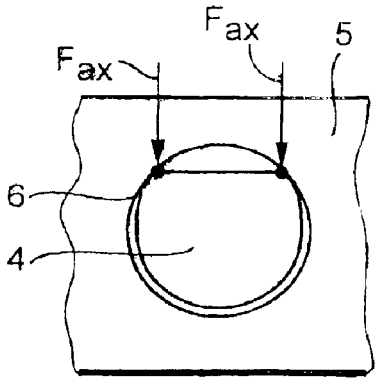
FIGS. 4*a* to 4*d* represent views of the driver arm contacting the wall of the engagement cavity in a wobble plate mechanism according to several different embodiments of the invention.

FIGS. 4*a* to 4*d* represent detail views of several different embodiments of the invention. FIG. 4*a* shows the driver arm head with the flattened portion 10. The flattened portion has rounded edges to smoothen the transition.

Figure 4B:
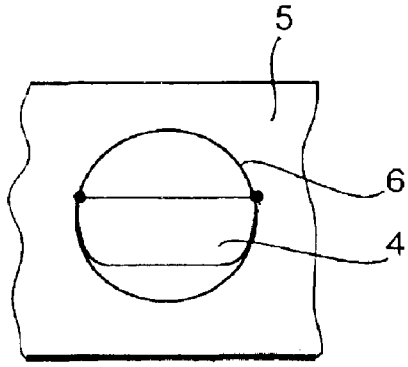

The driver arm head in FIG. 4*b* has an oval shape which likewise advantageously modifies the force introduction in comparison to a spherical driver arm head in a cylindrical engagement cavity. FIGS. 4*a* and 4*b* illustrate how the modified shape of the driver arm head in cooperation with the circular cross-section of the engagement cavity 6 creates two contact points to the right and left of the symmetry axis and thus at locations of greater wall thickness.

Figure 4C:
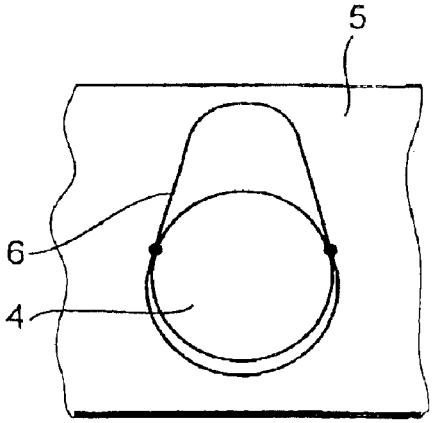
Figure 4D:
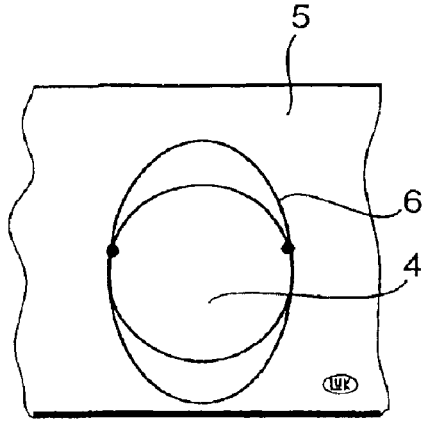

FIGS. 4*c* and 4*d* show a spherical driver arm head 4 in cooperation with an oval (Figure c) or elliptical (Figure d) cross-section of the engagement cavity 6. As can be seen clearly in the drawings, the contact forces in the embodiments of FIGS. 4*c* and 4*d* are again transmitted at two points, in contrast to the single point force that occurs with a spherical driver arm head in a circular cavity, and the two contact points are shifted to areas where the engagement cavity is separated by a greater wall thickness from the gliding surface.

Except for the areas of the engagement cavity 6 and the tilt-axle elements 12, 13, the annular wobble plate could be configured with integrally cast cooling fins in the manner of an internally self-ventilated brake disk, so that the heat generated by the friction of the glider shoes can be carried away from the wobble plate. Cooling fins of this type can in addition receive and circulate lubricants, which enhances the lubricating effect on the wobble plate, the glider shoes, the driver arm and the tilt-axle pivots.

What is claimed is:

1. A wobble plate mechanism for a reciprocating piston device, comprising:

a revolving wobble plate, a driving shaft, an axial guiding device through which the wobble plate is tiltably connected to the driving shaft, and a driver arm rigidly connected to the driving shaft and having a driver arm head providing a force-transmitting connection from the driving shaft to the wobble plate, wherein the wobble plate has an adjustable tilt angle and said revolving movement of the revolving wobble late drives a reciprocating movement of pistons in cylinders that run parallel to the driving shaft, wherein each of the pistons has a glider element supported in the piston with ball joint-like mobility, said glider element having a gliding engagement with gliding surfaces of the wobble plate, wherein said wobble plate is configured as a ring plate with an engagement cavity that is open at, least from a radially internal circumference and receives the driver arm head, said engagement cavity having an internal wall surface, wherein the driver arm head and the engagement cavity are shaped so that axially directed contact forces acting between the driver arm head and the internal wall surface occur at locations that are laterally removed from a thinnest material portion separating the engagement cavity from one of said gliding surfaces, wherein the wobble plate at said locations compared to said thinnest material portion has a greater wall thickness between the engagement cavity and said one of the gliding surfaces, wherein the driver arm head has a spherical shape except for a flattened surface portion facing in a direction parallel to the driving shaft towards said pistons, so that in a cross-section perpendicular to the driver arm, the driver arm head has an oval contour shape, and wherein the engagement cavity is cylindrical with a circular cross-section.

2. The wobble plate mechanism of claim 1, wherein the axially directed contact forces have the form of a contact pressure distributed over contact areas at said laterally removed locations.

3. The wobble plate mechanism of claim 2, wherein the wobble plate has a first side facing towards the pistons and a second side facing away from the pistons, and wherein in a plane defined by said contact forces the engagement cavity has a greater wall thickness towards said first side than towards said second side.

4. The wobble plate mechanism of claim 1, wherein said contact forces acting at the laterally removed locations relieve stress on the thinnest material portion.

5. The wobble plate mechanism of claim 1, wherein said contact forces acting at the laterally removed locations cause a lesser amount of deformation of said one of the gliding surfaces than would be caused by a contact force acting at the thinnest material portion.

6. A wobble plate mechanism for a reciprocating piston device, comprising:

a revolving wobble, plate, a driving shaft, an axial guiding device through which the wobble plate is tiltably connected to the driving shaft, and a driver arm rigidly connected to the driving shaft and having a driver, arm head providing a force-transmitting connection from the driving shaft to the wobble plate, wherein the wobble plate has an adjustable tilt angle and said revolving movement of the revolving wobble plate drives a reciprocating movement of pistons in cylinders that run parallel to the driving shaft, wherein each of the pistons has a glider element supported in the piston with ball joint-like mobility, said glider element having a gliding engagement with gliding surfaces of the wobble plate, wherein said wobble plate is configured as a ring plate with an engagement cavity that is open at least from a radially internal circumference and receives the driver arm head, said engagement cavity having an internal wall surface, wherein the driver arm head and the engagement cavity are shaped so that axially directed contact forces acting between the driver arm head and the internal wall surface occur at locations that are laterally removed from a thinnest material portion separating the engagement cavity from one of said gliding surfaces, wherein the wobble plate at said locations compared to said thinnest material portion has a greater wall thickness between the engagement cavity and said one of the gliding surfaces, and wherein the driver arm head is spherical and the engagement cavity has a cross-sectional shape that is elongated in a direction parallel to the driving shaft so that said cross-sectional shape resembles one of an ellipse and an oval.

7. The wobble plate mechanism of claim 6, wherein said contact forces acting at the laterally removed locations cause a lesser amount of deformation of said one of the gliding surfaces than would be caused by a contact force acting at the thinnest material portion.

8. The wobble plate mechanism of claim 6, wherein the axially directed contact forces have the form of a contact pressure distributed over contact areas at said laterally removed locations.

9. The wobble plate mechanism of claim 8, wherein the wobble plate has a first side facing towards the pistons and a second side facing away from the pistons, and wherein in a plane defined by said contact forces the engagement cavity has a greater wall thickness towards said first side than towards said second side.

10. The wobble plate mechanism of claim 6, wherein said contact forces acting at the laterally removed locations relieve stress on the thinnest material portion.

* * * * *